United States Patent [19]

Bopp

[11] Patent Number: 4,571,864

[45] Date of Patent: Feb. 25, 1986

[54] APPARATUS FOR TENSIONING RECTANGULAR PIECES OF FABRIC

[75] Inventor: Peter Bopp, Unterengstringen, Switzerland

[73] Assignee: G. Bopp & Co. AG, Zurich, Switzerland

[21] Appl. No.: 668,021

[22] Filed: Nov. 5, 1984

[30] Foreign Application Priority Data

Nov. 4, 1983 [CH] Switzerland ..... 5959/83

[51] Int. Cl.[4] ..... D06C 3/08

[52] U.S. Cl. ..... 38/102.5; 38/102.91; 101/127.1; 101/407 R; 160/380; 160/395

[58] Field of Search ..... 38/102.5, 102.91; 160/380, 392, 395; 101/127.1, 407 R

[56] References Cited

U.S. PATENT DOCUMENTS

| | | | |
|---|---|---|---|
| 3,962,805 | 6/1976 | Hamu | 38/102.5 |
| 3,978,905 | 9/1976 | de Lama et al. | 38/102.91 |
| 4,044,669 | 8/1977 | Luther | 101/127.1 |
| 4,156,399 | 5/1979 | Fieux | 38/102.5 |
| 4,179,830 | 12/1979 | Lamb | 38/102.5 |

FOREIGN PATENT DOCUMENTS

| | | | |
|---|---|---|---|
| 1802686 | 3/1978 | Fed. Rep. of Germany | 101/127.1 |
| 2486459 | 1/1982 | France | 38/102.91 |

*Primary Examiner*—Werner H. Schroeder
*Assistant Examiner*—Andrew M. Falik
*Attorney, Agent, or Firm*—Cushman, Darby & Cushman

[57] ABSTRACT

A tensioning device includes a tensioning frame having stretcher bars disposed in parallel pairs and displaceable relative to one another, on which bars the edges of a piece of fabric can be clamped. Each stretcher bar has two cooperating clamping devices which extend over the entire length of the stretcher bar, each device being formed by a tube of elastic material adapted to be pneumatically or hydraulically pressurized. Each tube is held in aligned grooves in a closed row of longitudinally movable runners. The clamping force obtained through pressurization acts at every point over the entire length of the clamped edge of the piece of fabric. The elongation of the tubes, which can be increased by gradually raising the pressure, follows the stretching of the piece of fabric during the tensioning operation. The runners move apart during this process, but without losses of tension occurring because of the resulting gaps. Uniform tensioning of the pieces of fabric in line with the threads is thus possible.

13 Claims, 8 Drawing Figures

APPARATUS FOR TENSIONING RECTANGULAR PIECES OF FABRIC

BACKGROUND OF THE INVENTION

The invention relates to an apparatus for tensioning rectangular pieces of fabric, particularly for making screen printing stencils. The apparatus comprises a tensioning frame consisting of stretcher bars disposed in parallel pairs, which are displaceable relative to one another, and have longitudinally movable clamping points which clamp a piece of fabric along its edges.

Screen printing stencils, such as are used in screen printing on ceramic, glass and plastics substrates and also on a large number of other printable materials, consist of screen material, stencil material and frame.

In the production of screen printing stencils, the screen material, which usually consists of a fine-mesh plastic or wire fabric, is mechanically tensioned in the weft and warp directions and, while in the tensioned state, is joined to the stencil frame, for example by adhesive bonding. For this purpose, tensioning devices are used, which make it possible to place the screen material under the required tension and to hold it under tension until completion of the bonding process. The screen material is subjected to an excess of tension in relation to the area of material tensioned, and, after the setting or drying of the adhesive, the frame is separated from the area of screen material, whereupon the pattern or design is applied.

Important properties determining the quality of a screen printing stencil are the degree and uniformity of the tensioning of the screen material. In the screen printing operation it is well known that the stencil is not laid against the substrate to be printed, but is held at a certain distance (stand-off) from the substrate. The contact pressure of the ink transfer member, the squeegee, is now so selected that along its line of application the squeegee presses the screen material against the substrate to be printed such that at all other points the screen material is not in contact with the substrate. This arrangement ensures that the image finally printed will correspond as closely as possible to that formed on the stencil.

During printing with stand-off, the screen material undergoes a geometrical modification. Through the contact pressure of the squeegee, the screen is stretched out of the flat two-dimensional position into a three-dimensional state. During the movement of the squeegee an additional tensioning of the screen material, caused by the stand-off, is temporarily added to the tensioning of the screen material produced during the production of the stencil. If the two tensions together exceed the elastic limit specific to the screen material, they may lead to irreversible stretching of the screen material, resulting in a considerable fall in tension. The screen printing stencil becomes unusable in this case. While printing with stand-off is still possible with an irreversibly stretched screen printing stencil of this kind, the contact between the stencil and the substrate is no longer defined by the line of application of the squeegee. A smeared, unclear image is printed. This defect also occurs if the screen material did not have the required tension at the outset. Finally, unclear printirg faults occur if the screen material has uneven tensions.

To sum up, it may be said that uniform tensioning of the screen material, has a decisive influence on printing results. The construction of the tensioning device which can uniformly control the degree of tensioning for different materials is therefore of great importance.

Tensioning devices of the type customary at the present time comprise a tensioning frame consisting of stretcher bars disposed in parallel pairs which are displaceable relative to one another. Numerous grippers or clips are mounted for longitudinal movement on the stretcher bars, and hold the piece of fabric fast along its edges. For the tensioning of the piece of fabric in the warp and weft directions, the stretcher bars are moved crosswise mechanically or pneumatically.

The reason for the arrangement on each stretcher bar of a large number of individual grippers mechanically independent of one another is as follows: if the piece of fabric is tensioned, for example, in the warp direction, those grippers which hold the piece of fabric in the weft direction must follow the elongation of the piece of fabric which occurs in the warp direction in order to ensure that the fabric is tensioned with the threads straight, particularly at the edges of the material. The same applies to elongation in the weft direction, where the grippers working in the warp direction are concerned. This requirement is met by guiding the grippers on each stretcher bar on rails, often with the aid of ball bearings.

Depending on the size of the piece of fabric to be tensioned, a large number of grippers may be required, so that the cost of manufacture of the tensioning device is increased. In addition, each gripper must be correctly applied to the fabric and closed before the tensioning operation making the clamping a time-consuming operation.

Despite the numerous grippers, the edge of the fabric is held only at individual points, and the tensioning force is applied only at these points. Between the grippers there may be a considerable loss of tension in the fabric. Uniform tensioning of the material is therefore impossible in this manner.

SUMMARY OF THE INVENTION

The invention seeks to provide a tensioning device of the kind first defined above, in which these disadvantages are avoided.

The solution provided by the invention is characterized in that each stretcher bar has two cooperating clamp means which extend over the entire length of the stretcher bar and each of which is formed by a tube of elastic material adapted to be pneumatically or hydraulically pressurized. This tube is held in aligned grooves in a closed row of runners which are mounted for longitudinal movement on a runner rail, and undergoes elongation when pressurized.

This solution firstly has the advantage that each edge of the fabric is secured as a whole by a single clamping movement. Secondly, through the use of pressurized tubes as clamping means, the edge of the material is held over its entire length when it is subjected to tensioning, so that the tension of the fabric is uniform.

DESCRIPTION OF THE PREFERRED EMBODIMENTS

Figure 1:
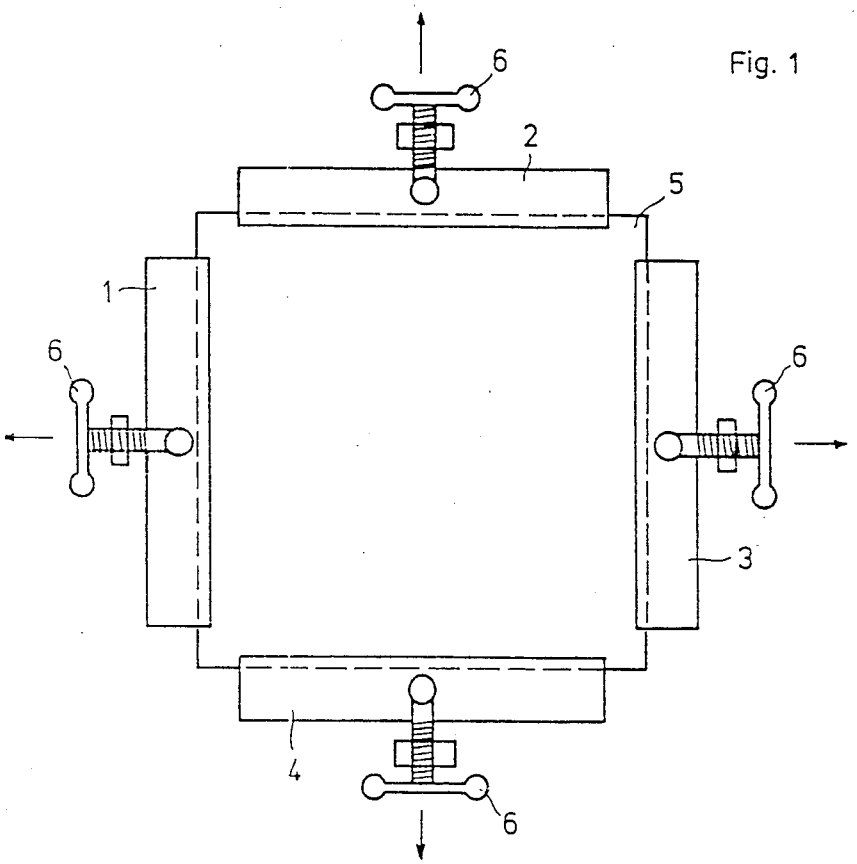
FIG. 1 is a plan view of the tensioning frame.

As shown in FIG. 1, the tensioning device comprises four stretcher bars 1, 2, 3 and 4, which are disposed in parallel pairs and together form the tensioning frame. Each stretcher bar holds fast one edge of the rectangular piece of fabric 5. The two parallel stretcher bars 1, 3 and 2, 4 respectively are displaceable relative to one another. The tensioning force is produced, for example by means of a spindle drive 6, on each stretcher bar. Instead, it is also possible to use, for example, pneumatically or hydraulically operated motors. During the tensioning operation, either both stretcher bars 1, 3 or 2, 4 of each pair may be moved in the direction of the arrows, or only one stretcher bar of each pair may be moved, while the opposite stretcher bar remains stationary. Parallelism of the pairs of stretcher bars may be obtained during this operation with the aid of mechanical means, for example with the aid of guide rods (not shown), or a floating fastening may be made between the stretcher bar and its operating means. In the latter case, the uniformity of the elongation of the fabric material determines the degree of parallelism of the stretcher bars.

Figure 2:
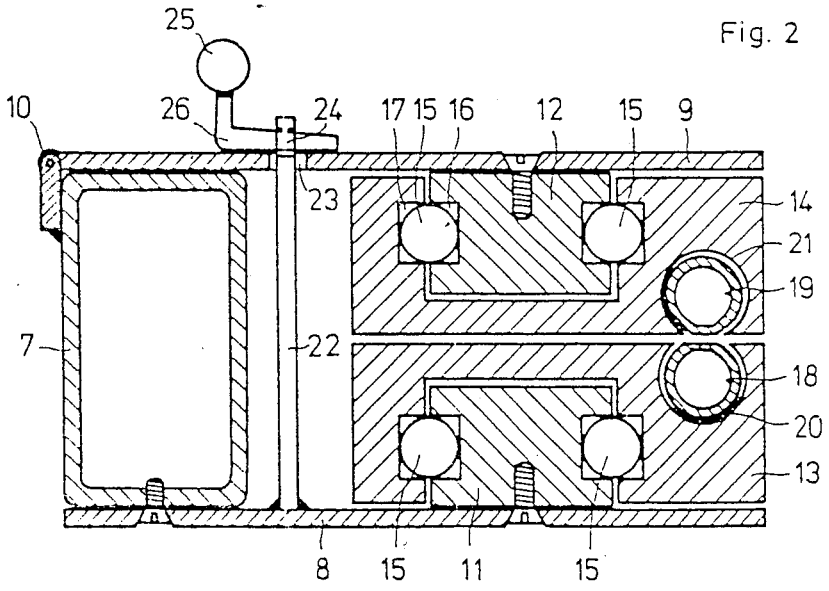
FIG. 2 is a cross-section of a stretcher bar.

The construction of the stretcher bars can be seen in FIG. 2. The stretcher bar comprises a fixed lower part and a hinged, openable upper part. The lower part consists of a carrier tube 7 and a base plate 8 fastened thereon, while the upper part consists of a pivoting plate 9 which is joined to the carrier plate 7 by a hinge 10 extending along the longitudinal axis. The base plate 8 and the pivoting plate 9 each carry on their mutually facing sides a runner rail 11 and 12 respectively, on which a number of runners 13 and 14 respectively, in a closed row, are mounted for longitudinal movement and are held positively. In the present example, rolling-contact bearings 15 are provided, the balls of the bearing being enclosed in longitudinal grooves 16 and 17 in the runner rails 11, 12 and runners 13, 14. Plain bearings would also be possible.

The two cooperating clamping means are formed by tubes 18 and 19 of elastic material, which are adapted to be pneumatically or hydraulically pressurized and which extend over the entire length of the stretcher bar. The runners 13 and 14 lying one above the other are provided with open longitudinal grooves 20 and 21 respectively, which face one another and in which the tubes 18 and 19 are embedded except for a free longitudinal portion required for the clamping function. To this end the grooves 20 and 21 in all the runners 13 and 14 of a row are in alignment with one another. The tubes 18 and 19 are connected at one end of the stretcher bar to a supply pipe for the pressure medium and are closed at the other end of the stretcher bar.

Because the hinge fastening 10 extends the length of the carrier tube, the entire upper part of the stretcher bar can be opened up for the insertion of an edge of the piece of fabric. In the closed position, the upper and lower parts of the stretcher bar can be fastened together by a locking means. This purpose is served by a retaining rod 22 which is fastened to the base plate 8 and passes through a hole 23 in the pivoting plate 9. A wedge 26 provided with a handle 25 can be inserted through a cross hole 24 in the retaining rod 22, and holds the pivoting plate 9 in the position shown in the Figure. Two or more such locking devices are preferably provided on a stretcher bar.

When the tubes 18 and 19 are pressurized, they produce, over the entire length of the stretcher bar, a clamping pressure on the previously inserted edge of the piece of fabric, whereby the latter is held fast on the stretcher bar.

During the subsequent tensioning operation, the stretcher bars 1 to 4, arranged as shown in FIG. 1, are moved in pairs a certain distance (tensioning path) away from one another in order to place the clamped piece of fabric 5 under the required tension. This necessarily gives rise to an elongation of the fabric material in the weft and warp directions. The stretcher bars must follow this elongation along the clamping line, that is to say the respective clamping line must increase in length to the extent of the tensioning path extending parallel to it. For this purpose, the tube pressure is increased with increasing tensioning force, whereby not only is the clamping force applied to the fabric material increased, but at the same time the tubes are lengthened and the runners 13, 14 are pushed apart. Nevertheless, in the gaps thus formed between the runners, the clamping action and the tensile force applied to the piece of fabric 5 are maintained, so that uniform tension in the weft and warp directions is achieved in the fabric.

In the case of mechanical movement of the stretcher bars, for example by means of the spindle drives 6 (FIG. 1), a pressure sensor (not shown) may indicate the tension of the fabric. In the case of pneumatic or hydraulic movement of the stretcher bars, the system pressure constitutes a measure of the fabric tension. The elongation of the tubes through the increase in pressure may be effected either manually or automatically. In the latter case, means (not shown) may be provided for controlling the tube pressure in dependence on the tensioning path of the stretcher bars.

The pressure-dependent extensibility of the tubes is expediently adapted to the stretchability of the respective fabric. For example, in the tensioning of synthetic fabrics, tubes having greater elasticity should be used than in the case of wire fabrics.

Figure 7:
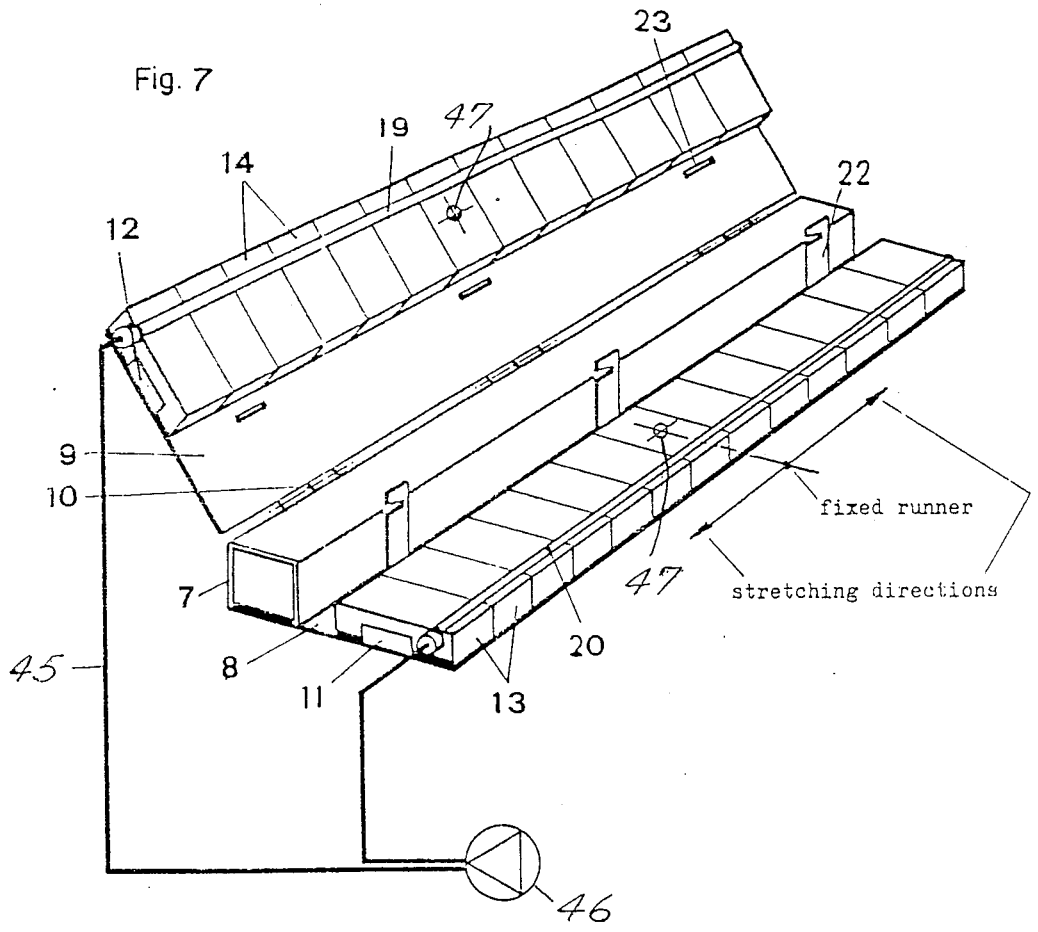
FIGS. 7 and 8 show the tensioning device in the open position.
Figure 8:
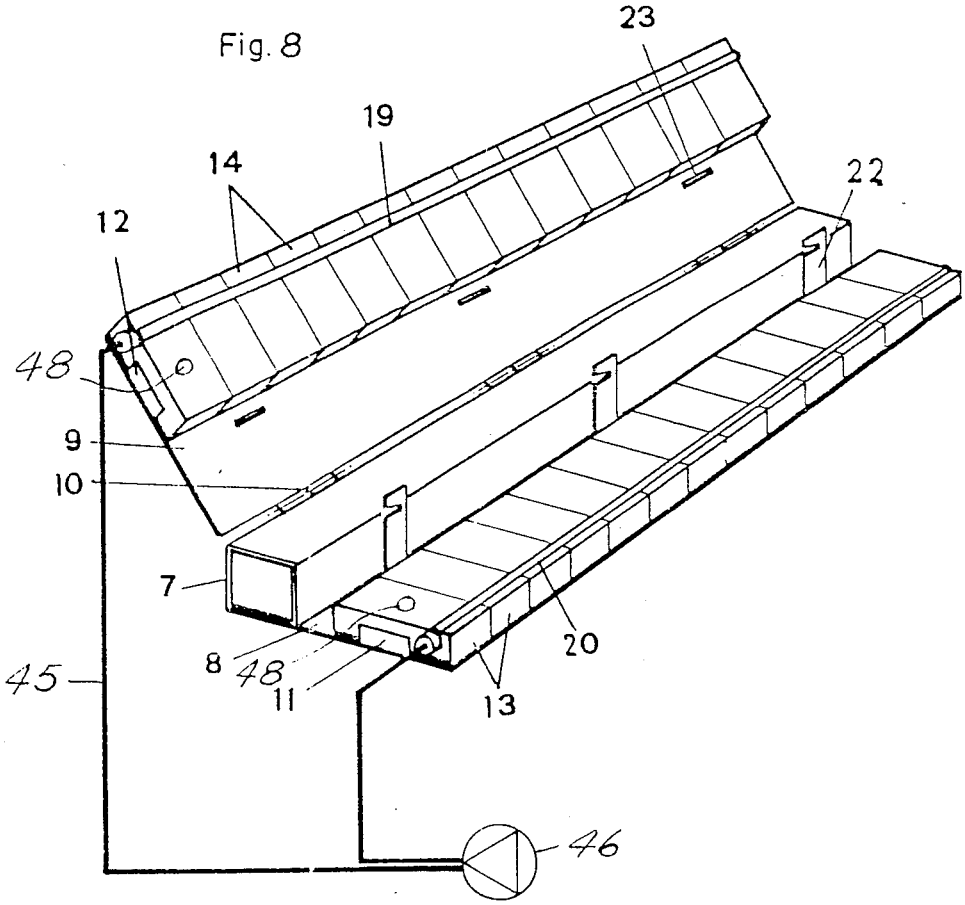

The elongation of the tubes may take place either from one end of the tubes in one direction, or from the center of the tubes in both directions. For this purpose, the runner rails may be provided, either at one end or at the center of the runner rails, with a stop 47 or 48 for the runners, the longitudinal movement of the runners taking place towards either one or both ends from this stop as shown in FIG. 7 and FIG. 8.

Figure 3:
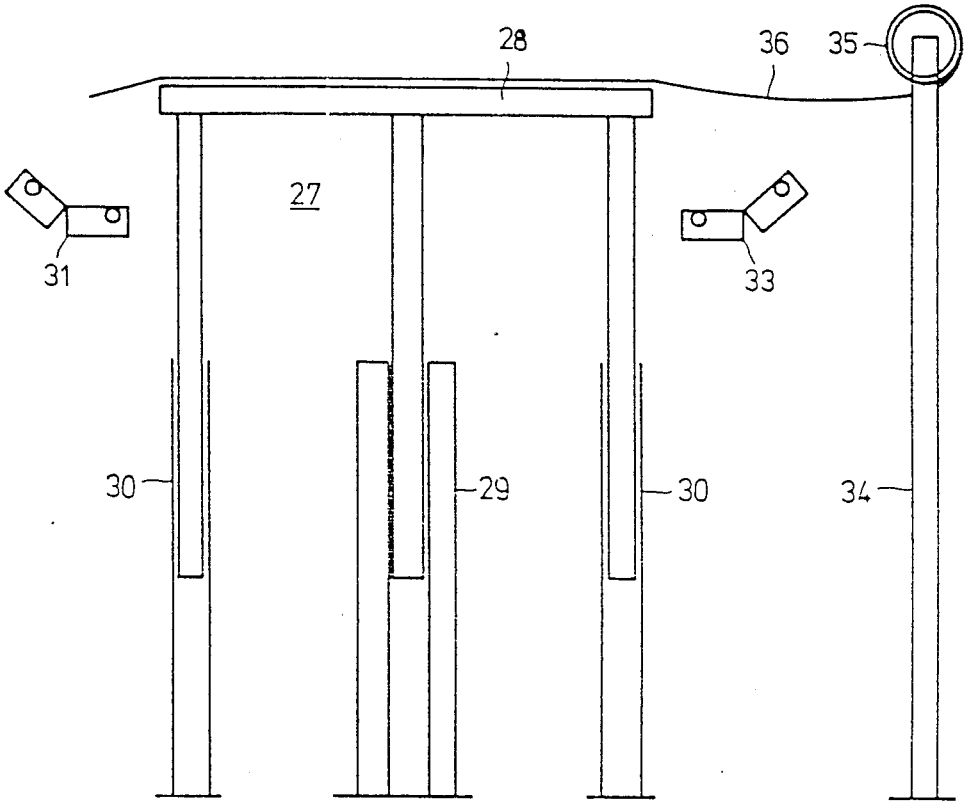
FIG. 3 shows a tensioning device in a first phase of operation.
Figure 4:
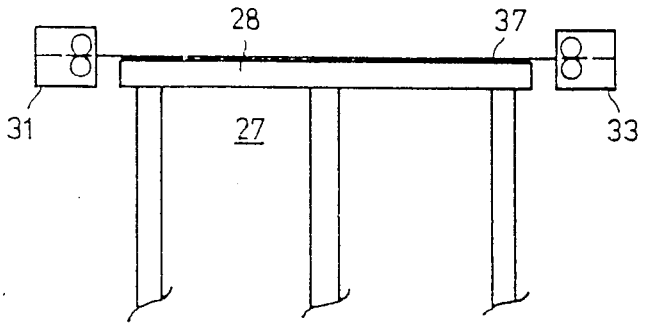
FIG. 4 shows a tensioning device in a second phase of operation.

In relation to the tensioning frame formed by the stretcher bars 1 to 4, the piece of fabric to be tensioned should be placed as accurately as possible at right angles, that is to say the warp and weft threads of the piece of fabric should extend as accurately as possible parallel to the respective stretcher bars. In addition, it should be possible for the operator, without great effort, to insert the piece of fabric into the tensioning frame without damaging it. For both these requirements, as shown in FIGS. 3 and 4, a vertically adjustable table 27 is disposed inside the tensioning frame, this table being provided with a table top adapted to move out to one side, as shown in detail in FIG. 5. In FIG. 3, a pneumatic cylinder 29 for the vertical adjustment of the table 27 and a plurality of telescopic guides 30 for stabilizing its horizontal position are shown. For the vertical adjustment, it is however also possible to provide a different drive, for example a spindle drive or a hydraulic cylinder. Two stretcher bars 31 and 33 of the tensioning frame lie opposite one another and are shown in the open position in FIG. 3 and in the closed position in FIG. 4.

For the production of screen printing stencils the procedure is essentially as follows:

For the preparation of the fabric, the table top 28 is first raised to a height above the level of the stretcher bars 31,33 (FIG. 3). In this position of the table, it is possible for the fabric 36, which is drawn off a roll 35 mounted on a stand 34, to be laid on the table top 28. The required length is cut off and the cut piece of fabric 37 is straightened out. For the insertion of the edges of the piece of fabric into the tensioning frame, the table top 28 is lowered to the level of the stretcher bars 31, 33. The stretcher bars are then closed (FIG. 4), whereupon the piece of fabric 37 is tensioned. The table top 28 is then further lowered and moved laterally out of the tensioning device so that one or more stencil frames can be laid on it and positioned in the desired manner. The table top 28 carrying the frame or frames is then pushed back and raised until the frame pieces are pressed against the tensioned piece of fabric 37. In conjunction with the drive means for the vertical adjustment of the table top 28, other means are preferably provided to enable the contact pressure to be previously adjusted. Thereupon adhesive can be applied to the frame pieces from the upper face of the piece of fabric 37. After the adhesive has set, the stencil frame can be separated from the piece of fabric 37.

Figure 5:
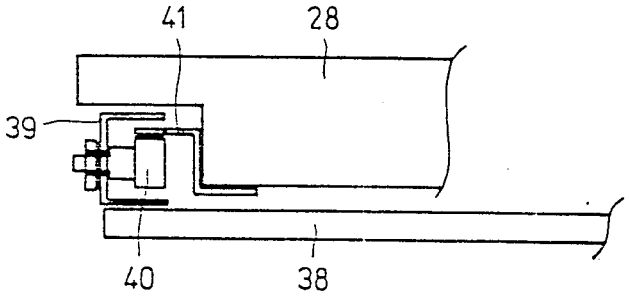
FIGS. 5 and 6 are detail views of a work table.

FIG. 5 shows the constructional means for the slidable mounting of the table top 28. On two parallel edges of a support 38, a C-shaped guide rail 39 is mounted in each case. Rollers 40 are fastened in the guide rail and in turn carry the table top 28 by means of an angle bar 41.

In a screen printing stencil produced in the manner described, the fabric tension loads the frame pieces, which yield to a greater or lesser extent depending on their strength, and this entails a loss of tension.

Figure 6:
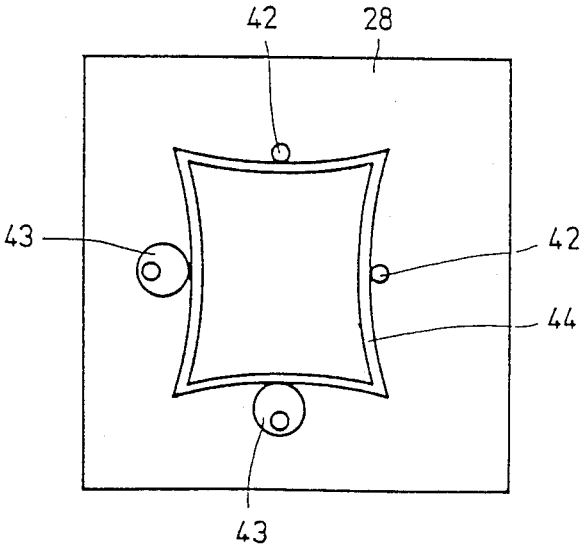

In order also to avoid this disadvantage, as shown in FIG. 6, retaining pins 42 and eccentric discs 43 can be inserted in selectable positions on the table top 28, in order to enable the stencil frame 44 to be elastically pre-tensioned before its adhesive bonding to the piece of fabric. After the stencil frame carrying the piece of fabric has been removed from the tensioning device, this pre-tensioning counteracts the tension in the fabric, so that the loss of tension which would otherwise occur is balanced.

What is claimed is:

1. An apparatus for tensioning pieces of fabric comprising a tensioning frame, said frame comprising at least two pairs of opposed stretcher bars displaceable relative to one another, the stretcher bars having two cooperating clamping means opposed to one another for clamping a piece of fabric, the clamping means having a rail carrying a plurality of runners slidable thereon, the runners having a longitudinal groove receiving an expansible tube member extending the entire length of the stretcher bar and capable of radial and longitudinal expansion when pressurized, whereby the cooperating tubes clamp the fabric.

2. An apparatus according to claim 1, wherein the stretcher bar has an upper and a lower part, these parts being movably joined together by a hinge extending along a longitudinal axis and being adapted to be fastened together in the folded state by a locking means, the upper and lower parts each carrying on the sides facing one another a rail on which the runners are positively held, such that the longitudinal grooves of the runners face one another and in which the tubes are embedded except for a free longitudinal portion required for the clamping function.

3. An apparatus according to claim 1, wherein the tubes are connected at one end of the stretcher bar to a supply pipe for the pressure medium and are closed at the other end of the stretcher bar.

4. An apparatus according to claim 1, wherein the runner rails are provided at one end with a stop for the runners, from which stop the longitudinal movement of the runners can take place in one direction.

5. An apparatus according to claim 1, wherein the runner rails are provided at their center with a stop member whereby the longitudinal movement of runners occur outwardly from the stop.

6. An apparatus according to claim 1, wherein a vertically adjustable table is disposed inside the tensioning frame.

7. An apparatus according to claim 6, wherein the table top is adapted to be moved out to one side.

8. An apparatus according to claim 6, where means are provided for enabling a frame disposed on the vertically adjustable table top to be pressed with preselectable contact pressure against the tensioned piece of fabric.

9. An apparatus according to claim 6, where retaining pins and eccentric discs are inserted in selectable positions on the table top to enable a frame laid on the table top to be pretensioned.

10. An apparatus according to claim 1, where the tube is pressurized pneumatically.

11. An apparatus according to claim 1, where the tube is pressurized hydraulically.

12. An apparatus according to claim 1, where the runners move longitudinally along the rail according to the longitudinal expansion of the tube.

13. An apparatus according to claim 1, where the gripping strength of the clamping means is determined by the pressure within the tube.

* * * * *